US007524126B2

(12) United States Patent
Gueret

(10) Patent No.: US 7,524,126 B2
(45) Date of Patent: Apr. 28, 2009

(54) DEVICE FOR PACKAGING AND/OR DISPENSING A PRODUCT AND MANUFACTURING METHODS

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 11/819,106

(22) Filed: Jun. 25, 2007

(65) Prior Publication Data

US 2008/0003046 A1 Jan. 3, 2008

Related U.S. Application Data

(62) Division of application No. 10/694,905, filed on Oct. 29, 2003, now Pat. No. 7,234,885.

(60) Provisional application No. 60/442,907, filed on Jan. 28, 2003.

(30) Foreign Application Priority Data

Oct. 29, 2002 (FR) ..... 02 13515

(51) Int. Cl.
*B05C 17/00* (2006.01)

(52) U.S. Cl. ..... 401/215; 401/209; 401/49; 401/126

(58) Field of Classification Search ..... 401/52, 401/88, 49, 209, 215, 265, 126
See application file for complete search history.

(56) References Cited

U.S. PATENT DOCUMENTS 6,818,603 B2 * 11/2004 Aleles et al. ..... 510/148

* cited by examiner

*Primary Examiner*—David J Walczak
(74) *Attorney, Agent, or Firm*—Finnegan, Henderson, Farabow, Garrett & Dunner, L.L.P.

(57) ABSTRACT

A device for at least one of packaging and dispensing a product may include a receptacle configured to contain a product and at least one body. The at least one body may include a binder and a plurality of particles associated with the binder. The at least one body may define at least one cavity visible to the naked eye, and the device may be configured so that, at least during use of the device, the at least one body is at least partially in contact with the product and at least some of the plurality of particles is at least partially in contact with the product.

3 Claims, 4 Drawing Sheets

DEVICE FOR PACKAGING AND/OR DISPENSING A PRODUCT AND MANUFACTURING METHODS

This is a division of application Ser. No. 10/694,905, filed Oct. 29, 2003, now U.S. Pat. No. 7,234,885, and claims the benefit of U.S. provisional application No. 60/442,907, filed Jan. 28, 2003.

The present invention relates to a device for packaging and/or dispensing a product, for example, a cosmetic product and/or a beauty care product. For example, the device may be used to apply cosmetic products such as those defined in Counsel Directive 93/35/EEC (European Economic Community) dated Jun. 14, 1993, which provides merely one example of a definition of cosmetic products and should not be considered as limiting.

Some cosmetic products packaged in containers incorporate preservatives. It may be desirable in some cases, however, to reduce the content of preservatives in the product, for example, at the time of packaging.

One subject of the invention relates to reducing the content of preservatives in the product at the time of packaging. Another subject of the invention relates to a desire, for example, after the product has been packaged, to impart properties to the product that it does not possess at the time of packaging.

Although the present invention may obviate one or more of the above-mentioned needs, it should be understood that some aspects of the invention might not necessarily obviate one or more of those needs.

In the following description, certain aspects and embodiments will become evident. It should be understood that the invention, in its broadest sense, could be practiced without having one or more features of these aspects and embodiments. It should also be understood that these aspects and embodiments are merely exemplary.

In one aspect, as embodied and broadly described herein, the invention includes a device for at least one of packaging and dispensing a product. The device may include a receptacle configured to contain a product and at least one body. The at least one body may include a binder and a plurality of particles associated with the binder. The at least one body may define at least one cavity visible to the naked eye, and the device may be configured so that, at least during use of the device, the at least one body may be at least partially in contact with the product and at least some of the plurality of particles may be at least partially in contact with the product. For example, at least some of the plurality of particles may be at least partially in direct contact with the product.

As used herein, the term "visible to the naked eye" means visible to a person having generally 20/20 vision (without the aide of any magnifying device, such as, for example, a magnifying glass and/or microscope, other than lenses that might be used to correct the viewer's vision to 20/20) when the at least one body is held at the viewer's arm's length (or closer) and viewed outside the receptacle (with the surface of the at least one body being substantially free from product substantially obscuring the view of cavities of the at least one body). For example, a body would have at least one cavity visible to the naked eye if a person having 20/20 vision is able to see one or more cavities while the body is positioned no further than an arm's length distance from the person and while the body is outside the receptacle.

According to another aspect, the product may include at least one of a solid, a powder, a liquid, and a gel. According to yet another aspect, the binder may include an organic material and/or a mineral material. In still a further aspect, the binder may include a liquid and/or oil, for example, water.

In still another aspect, depending on the nature of the particles, substances may be diffused into the product and/or reactions may be induced in the product, for example, so as to impart particular properties to the product. For example, particles may be selected so as to induce the diffusion into the product of substances that may have an effect on the product's preservation and may enable the content of any preservatives in the product to be reduced, for example, at the time of packaging the product.

According to a further aspect, the at least one cavity may have an effect of increasing an exchange surface area with the product, which may render it possible to increase the quantity of any substances released by particles from the at least one body into the product.

According to another aspect, the particles may at least partially include at least one of mineral material and vegetable material. For example, the particles may include a mineral powder.

In yet another aspect, at least some of the particles may include at least one material selected from metal, metal alloy, cobalt, barium, chromium, aluminium, silver, copper, titanium, bronze, manganese, metal oxide, bauxite, iron oxide, ferrite, copper oxide, silver oxide, salt, carbonate, calcium carbonate, barium sulphate, non-ferrous compound, awl stone, sulphur, carbon, oligo-element, sea salt, rock salt, alumina, kaolin, clay, sandstone, lime, steatite, algae, algae extract, plankton, plankton extract, bactericidal agent, vitamin, protein, acid, hormone, collagen, alum, silk, hemp, wax, and oil.

In still another aspect, the at least one body may include a magnet. For example, the at least one body may be formed around a magnet, for example, via overmolding. In yet another aspect, the magnet may be larger than at least some of the particles. Alternatively, or in addition, the magnet may be smaller than at least some of the particles.

According to yet another aspect, the at least one body may include at least one moisture absorber. For example, the at least one moisture absorber may include at least one material selected from polyacrylate, colloidal silica gel, alginate, and cotton. The inclusion of at least one moisture absorber may, for example, render it possible for a product contained in the receptacle to diffuse more deeply into the body and/or facilitate contact between the particles and the product.

In still another aspect, the binder may include a thermoplastic polymer and/or a thermo-hardening polymer. The binder may, for example, be polymerizable in hot and/or cold conditions, and may include a polymerization catalyst if desired.

In yet a further aspect, the binder may include at least one material selected from polypropylene (PP), polystyrene (PS), polyethylene, polyamide (PA), polyamide 6 (PA 6), polyester (PET), polyoxymethylene (POM), methacrylate, urea-formaldehyde, melamine, cyanoacrylate, and polyacrylate.

According to yet another aspect, the at least one body may include a ceramic.

In still another aspect, at least some of the particles may have a size dimension (e.g., diameter, length, and/or diameter of an imaginary circle that would surround a particle) ranging from about 0.1 micron to about 200 microns. For example, the size dimension may range from about 0.1 micron to about 150 microns (e.g., between about 1 micron and about 100 microns). The size dimension may range from about 1 micron to about 50 microns, for example, from about 1 micron to about 20 microns. (e.g., about 10 microns).

According to another aspect, the at least one body may include, for example, from about 5% to about 90% by weight of the particles, for example, from about 10% to about 75% by weight of the particles. For example, the at least one body may include from about 20% to about 70% by weight of the particles, for example, more than about 40% by weight of the particles (e.g., more than about 50% or about 60% by weight of the particles).

In one aspect, the at least one body may include at least one moisture absorber. For example, the at least one moisture absorber may include at least one material selected from polyacrylate, colloidal silica gel, alginate, and cotton.

In yet another aspect, the at least one body may, for example, include between about 1% and about 80% by weight of alumina powder, for example, between about 15% and about 70% by weight of alumina powder with a moisture absorber.

In still another aspect, the at least one body may, for example, include from about 5% to about 80% (e.g., between about 5% and about 80%) by weight of a mixture including alumina and silver powder. Alternatively, the at least one body may include from about 10% to about 75% (e.g., between about 10% and about 75%) by weight of a mixture including alumina and copper powder.

According to yet another aspect, at least some of the particles may be coated particles and/or at least some of the particles may be uncoated particles. For example, a coating material for coated particles may be selected so as to allow one or more substances included in some of the particles to be released into the product and may allow the one or more substances to diffuse through the product (and/or to diffuse through the coating).

According to still another aspect, at least some of the particles may be configured to release ions on contact with the product. For example, at least some of the particles may include silver and/or a silver salt, and the ions released may be $Ag^+$ (silver) ions having biocide properties.

In still another aspect, at least some of the particles may include at least one element having at least one of a purifying property, antiseptic property, circulation promoting property, regenerative property, cicatrisant (scar-forming) property, analgesic property, anti-wrinkle property, anti-oxidant property, bactericidal property, and drying property. The particles may have one or more other properties as well.

According to a further aspect, the at least one cavity may be formed in a variety of ways. For example, the at least one body may include at least one of one or more through holes and one or more blind holes, for example, in the form of a crater, a space formed between ribs and/or fins and/or delineated by a dihedron and/or by any not entirely convex surface.

In still another aspect, the at least one body may include a shape selected from one of substantially spherical, substantially cylindrical, substantially annular, and substantially polyhedral. The at least one body may include, for example, at least one rib and/or at least one through hole. The at least one body may include an at least partially smooth external surface.

According to yet another aspect, the at least one body may be loose in the receptacle. For example, the at least one body may serve to substantially homogenize the product when the receptacle is shaken.

In still another aspect, the device may include a retaining portion configured to retain the at least one body above a level of product contained in the receptacle when the device is placed in an upright orientation, for example, when the device is placed on a substantially horizontal, flat surface. For example, the retaining portion and the at least one body may be configured such that the at least one body is able to rotate within the retaining portion.

According to another aspect, the device may be configured such that the at least one body defines a surface configured to apply the product. In still another aspect, the at least one body may be configured to be mounted to the receptacle in a removable manner. For example, the device may include a closure element that may have an appendage (e.g., a rod), wherein the at least one body may be associated with (e.g., attached to) the appendage.

In still another aspect, dimensions of the at least one body may be selected in relation to dimensions of the receptacle, the nature of the product, and the function to be performed by the at least one body. For example, the at least one body may have a maximum size dimension ranging from about 5 millimeters to about 50 millimeters (e.g., the maximum size dimension may range from about 7 millimeters to about 40 millimeters).

According to yet another aspect, the device may include more than one body. For example, the device may include two bodies. In still another aspect, when there is more than one body, two or more bodies may (or may not be) identical and/or may (or may not) contain particles of the same type.

In still another aspect, the at least one body may include a polymer binder, and the at least one body may be formed via, for example, molding (e.g., via injection molding). The at least one body may include a ceramic and the at least one body may be fabricated via a process including, for example, a firing process. The presence of the at least one cavity may render it possible to reduce the quantity of material included in the at least one body, and may reduce the cost of the at least one body.

According to still another aspect, the device may include a product contained in the receptacle. In still a further aspect, the product may be substantially free of any preservatives. According to yet another aspect, the product may include at least one of a cosmetic product and a beauty care product.

In still another aspect, a method for manufacturing a body configured to be placed in contact with at least one of a cosmetic product and a beauty care product may include providing at least one body defining an outer surface. The at least one body may include a binder and plurality of particles in the binder. The method may include abrading the at least one body so as to at least partially expose at least some of the plurality of particles at the outer surface of the at least one body.

The term "providing" is used in a broad sense, and refers to, but is not limited to, making available for use, enabling usage, giving, supplying, obtaining, getting a hold of, acquiring, purchasing, manufacturing, selling, distributing, possessing, making ready for use, and/or placing in a position ready for use.

According to still another aspect, the at least one body may include a polymer. In yet a further aspect, the at least one body may be formed via molding at least one material such that the at least one body defines at least one cavity visible to the naked eye.

In still an additional aspect, a method of manufacturing a device for at least one of packaging and dispensing one of a cosmetic product and a beauty care product may include manufacturing at least one body, and inserting the at least one body into a receptacle of a device for at least one of packaging and dispensing one of a cosmetic product and a beauty care product.

The accompanying drawings are incorporated in and constitute a part of this specification. The drawings illustrate exemplary embodiments of the invention and, together with the description, serve to explain some principles of the invention. In the drawings, FIG. 1 is a schematic partial section view of an embodiment of a device for packaging and/or dispensing a product;

Reference will now be made in detail to some possible embodiments of the invention, examples of which are illustrated in the accompanying drawings. Wherever possible, the same reference numbers are used in the drawings and the description to refer to the same or like parts.

Figure 1:
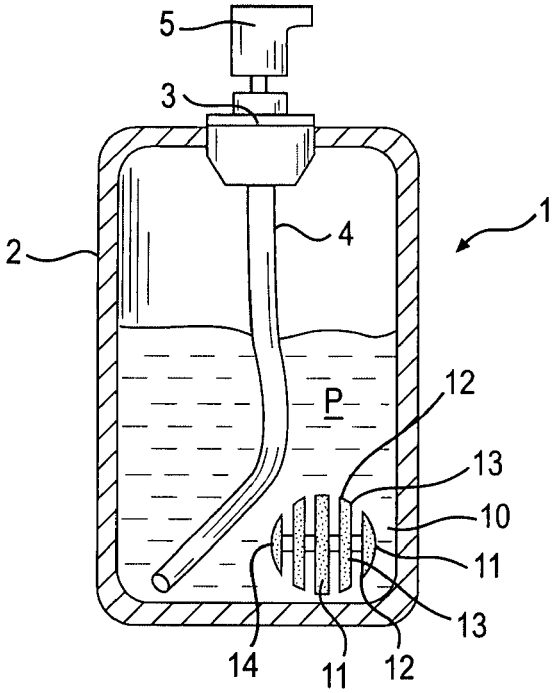

FIG. 1 depicts an exemplary embodiment of a device 1 for packaging and/or dispensing a product P, for example, a cosmetic product and/or beauty care product. The device 1 may include a receptacle 2 for containing the product P and a dispensing element 3 such as, for example, a pump or valve enabling the product P to be dispensed. In the exemplary embodiment depicted in FIG. 1, the device 1 may include a dip tube 4 connected to the dispensing element 3, which may be actuated, for example, by a pushbutton 5 having a dispensing aperture (not shown). The receptacle 2 may include a wall that may include at least a portion that is substantially transparent, substantially translucent, and/or substantially opaque.

The device 1 may include a body 10 contained at least partially within the receptacle 2. The body 10 may be, for example, contained within the receptacle 2 in a loose fashion, and may be at least partially immersed in the product P. The body 10 may be used, for example, to mix (e.g., substantially homogenize) the product P via shaking the receptacle 2.

Figure 3:
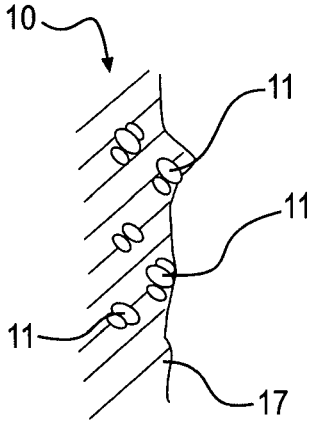
FIG. 3 is a partial schematic section view of a portion of the body of FIG. 2.

As depicted in FIG. 3, the body 10 may include particles 11. The particles 11 may be dispersed, for example, in a substantially homogeneous manner in a binder 17 and/or on the surface of the body 10. At least some of the particles 11 located on the surface of the body 10 may be at least partially in direct contact with the product P. The particles 11 of the body 10 may (or may not be) of the same nature. For example, the body 10 may include a mixture of particles 11 that include differing materials, and the body 10 may also include particles (not shown) that may be substantially or totally inert with respect to the product P.

The particles 11 may be selected so as to exert an action on the product P, for example, to release a substance into the product P. The particles 11 may be, for example, able to release ions having, for example, a biocide effect that may be conducive to improved preservation of the product P.

For example, according to some exemplary embodiments, the body 10 may include about 30% by weight of polyamide 6, about 69.5% by weight alumina powder, and about 0.5% by weight salts of silver and/or copper. A body 10 having such a composition may, for example, possess antibacterial properties by virtue of the diffusion of silver and/or copper ions into the product P, and may enable the quantity of preservatives used in association with the device 1 to be reduced. The body 10 may alternatively include, for example, about 60% by weight clay powder, about 10% by weight of ferrite powder, and about 30% by weight polypropylene. A body 10 having such a composition may be capable of being magnetized so as to, for example, additionally exhibit magnetic properties.

Figure 3A:
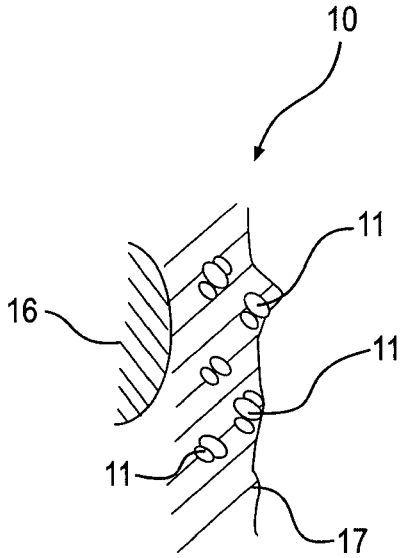
FIG. 3A is a partial schematic section view similar to FIG. 3, showing an alternative embodiment of a body.

In the exemplary embodiment depicted in FIG. 3A, a body 10 may be magnetized, for example, by the incorporation of a magnet 16 into the body 10. The body 10 may be formed around the magnet 16, for example, via overmolding. In some embodiments, magnet 16, for example, as shown in FIG. 3A, may be larger than the particles 11. Alternatively, the magnet 16 may be smaller than the particles 11.

Figure 4:
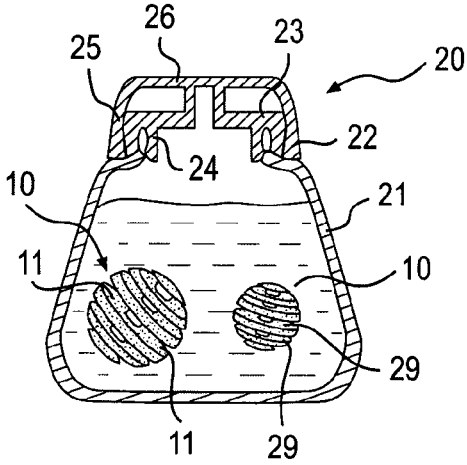
FIG. 4 is a schematic partial section view of another embodiment of a device.

FIG. 4 depicts an exemplary embodiment of a device 1 that may include two bodies 10 disposed within the receptacle 2. Each body may be magnetized with different magnet forces, for example, such that the two bodies 10 are attracted to one another (e.g., stick to one another). When shaking the receptacle 2, the shaking forces may be sufficient to at least temporarily separate the two bodies 10, and, additionally, new magnetic fields may be created.

In other exemplary embodiments (not shown), the receptacle 2 may contain more than two bodies 10 (e.g., enough bodies 10 to substantially fill the receptacle 2). Such embodiments may maximize an amount of exchange surface of the bodies 10 that may be exposed to the product P (e.g., the product P being present within gaps between bodies 10 and/or within the cavities of the bodies 10).

Figure 2:
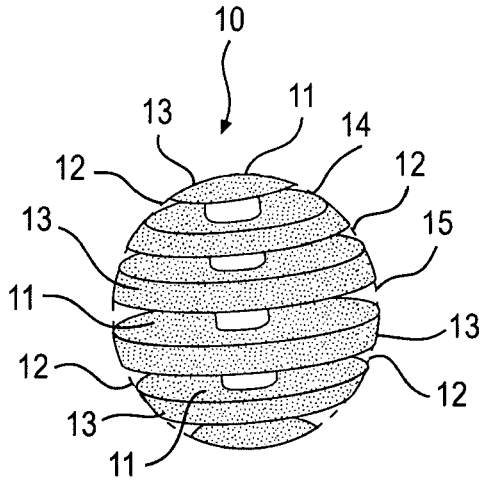
FIG. 2 is a schematic perspective view of a body of the device of FIG. 1.

The exemplary embodiment of a body 10 depicted in FIG. 2 may have a generally spherical shape and may include one or more cavities 12 that may be visible to the naked eye. The one or more cavities 12 may create an increase in an exchange surface area for the product P. Such cavities 12 may be formed, for example, via annular grooves extending between fins 13 that may be in the form of, for example, a discoid shape connected by a core 14 (e.g., a central core).

Rather than including a single body 10, some exemplary embodiments of the device 1 may include more than one body 10. For example, as mentioned above, the exemplary embodiment depicted in FIG. 4 may include two bodies 10. This embodiment may include a receptacle 21 having a neck 22, for example, that may be fitted with a flow reducer 23 that may include an inner sealing lip 24 and an outer threaded skirt 25 that may enable a closure cap 26 to be attached to the receptacle 21. In embodiments having more than one body 10, the bodies 10 may be substantially the same size. Alternatively, the bodies 10 may have different dimensions (e.g., as depicted in FIG. 4) and/or different shapes (not shown). The bodies 10 may incorporate different materials (e.g., different polymer materials) and/or differing particles (e.g., particles having different sizes, different shapes, and/or different compositions).

In some exemplary embodiments, one or more of the bodies 10 may not be immersed in the product P (e.g., when the device is not being used). Rather, the one or more bodies 10 may contact with the product P during the application and/or dispensing of the product P. For example, the exemplary embodiment of device 30 depicted in FIG. 5 may include a receptacle 31 and a flow reducer 32 mounted via, for example, a snap-on fastening to the receptacle 31, and the flow reducer 32 may define a housing 33 that retains the body 10. The body 10 may be located above the level of the product P contained in the receptacle 31, for example, when the device 30 is placed in an upright orientation on, for example, a horizontal, flat surface. In some exemplary embodiments, the body 10 may be substantially free to rotate in the housing 33. In other embodiments, the body 10 may be substantially prevented from rotating in the housing 33. The receptacle 31 may be closed via, for example, a closure cap 35 that may include a sealing element 36 (e.g., a central sealing skirt) that engages an aperture of the housing 33.

When the receptacle 31 is tilted to dispense the product P, the product P may flow through, for example, passages formed in the body 10, and between the body 10 and the wall of the housing 33. Within the passages, for example, the product P may be exposed to one or more substances released by particles 11 present at the surface of the body 10.

Figure 5:
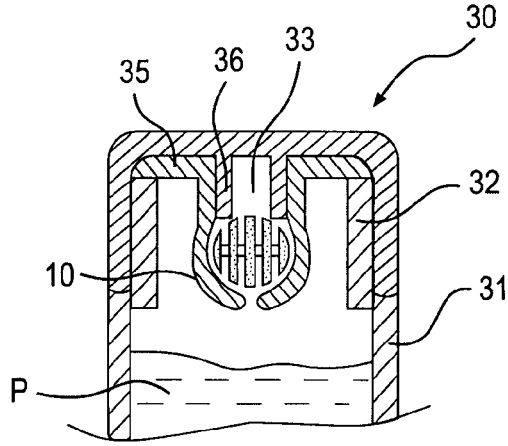
FIG. 5 is a schematic partial section view of a further embodiment of a device.

In the exemplary embodiment of a device 30 depicted in FIG. 5, the body 10 may be held, for example, by counterpart portions (e.g., counterpart portions that form a spherical portion) of the housing 33. Alternatively, in some exemplary embodiments, the body 10 may be held in the housing 33 by a fitted component (not shown).

Figure 6:
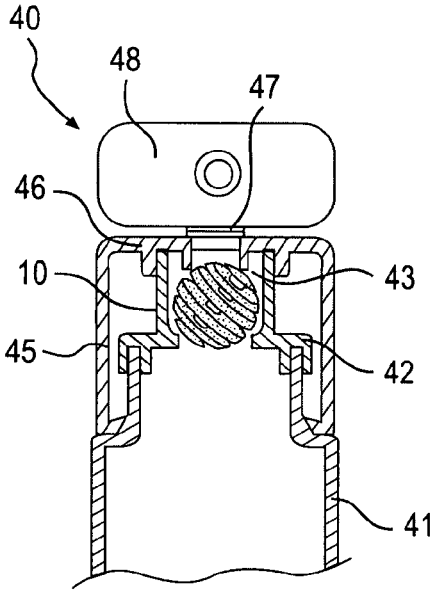
FIG. 6 is a schematic partial section view of another embodiment of a device.

FIG. 6 depicts an exemplary embodiment of a device 40 that may include a receptacle 41 to which may be mounted an intermediate part 42 defining a housing 43 configured to retain the body 10. The body 10 may be retained in the housing 43 by, for example, a closure capsule 46 that may be attached to the receptacle 41. The closure capsule 46 may include a hinge 47 (e.g., a film hinge), and the hinge 47 may connect a base part 45, which may be mounted to (e.g., attached to) the receptacle 41, for example, via a snap-on connection, and a pivoting cover 48.

Figure 7:
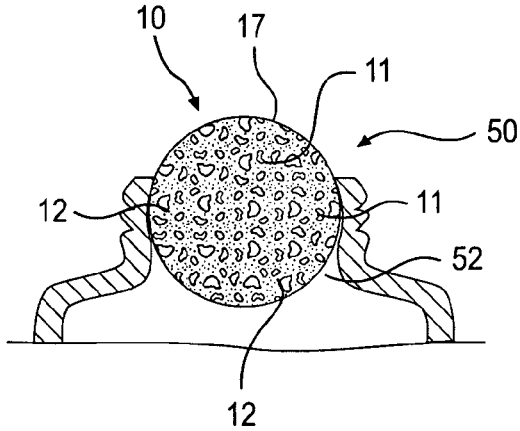
FIG. 7 is a schematic partial section view of a further embodiment of a device.

In the exemplary embodiment depicted in FIG. 7, at least part of the surface of the body 10 may serve to apply the product P. For example, a device 50 may include a body 10 having a substantially spherical shape that may serve to apply the product P. The body 10 may be configured to rotate in a housing 52, for example, in the manner of a "roll-on"-type applicator. The body 10 may include cavities 12, for example, formed by depressions that do not substantially impede rotation of the body 10 in the housing 52, while increasing a contact surface area between the body 10 and the product P.

Figure 16:
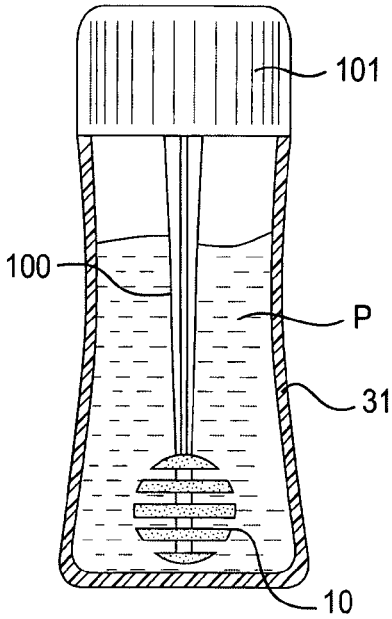
FIG. 16 is a schematic partial section view of another embodiment of a device.

FIG. 16 depicts an exemplary embodiment of a device that may include a body 10 associated with (e.g., connected to) an appendage 100 (e.g., a rod). The appendage 100 may be, for example, mounted to a closure element 101 (e.g., such as the closure capsule 46). When the closure element 101 is at least partially mounted to the receptacle 31, the body 10 may be at least partially immersed in the product P. The level of immersion of the body 10 in the product P may be at least partially dependent on the length of the appendage 100 relative to the depth of the receptacle 31, and relative to the level of product P contained in this receptacle 31. The appendage 100 may be formed, for example, via molding with the body 10 and/or the closure capsule 46. The appendage 100 may have, for example, a substantially cylindrical cross-section, may include a longitudinal groove, and may have a tapered shape, with the body 10 being located at an extremity of the appendage 100. Alternatively, the appendage 100 may have alternative cross-sections, no groove or more than one groove, and/or a non-tapering shape, and/or the body 10 may be located anywhere along the length of the appendage 100.

The body 10 may have configurations other than those depicted in FIGS. 1-7 and 16. For example, the cavities 12 may be formed in numerous ways.

Figure 8:
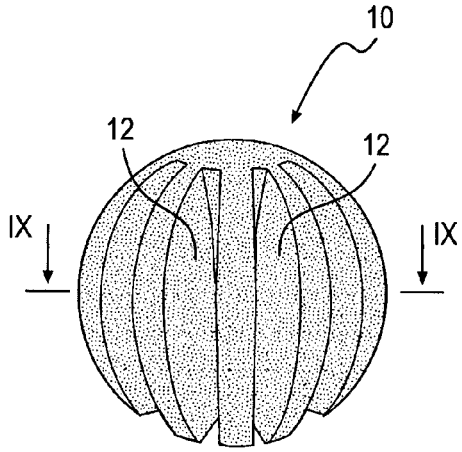
FIG. 8 is a schematic perspective view of another embodiment of a body.
Figure 9:
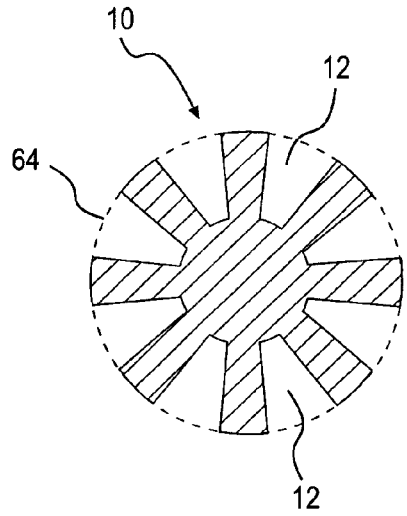
FIG. 9 is section view along line IX-IX of FIG. 8.

FIGS. 8 and 9 depict an exemplary embodiment of a body 10 that may have a substantially spherical overall shape that may include one or more cavities 12 defined by, for example, groove(s) extending substantially parallel to meridian lines of the body 10.

Figure 10:
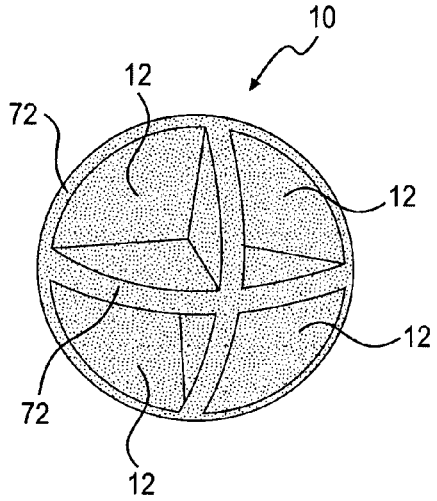
FIG. 10 is a schematic perspective view of a further embodiment of a body.

FIG. 10 depicts an exemplary embodiment of a body 10 that may have a substantially spherical overall shape that may include one or more cavities 12, at least some of which may occupy, for example, substantially a quarter hemisphere (e.g., when the body 10 is substantially spherical shaped), separated by partitions 72 in the form of, for example, quarter portions of a disc.

Figure 11:
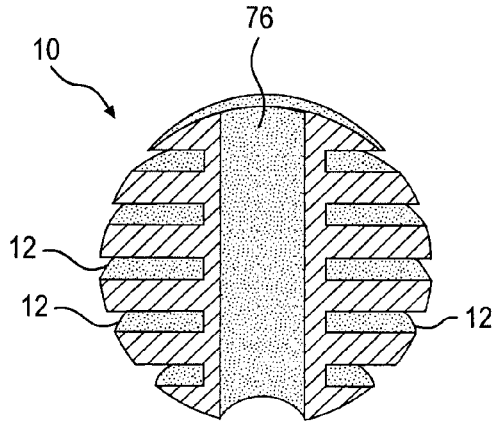
FIG. 11 is a schematic perspective section view of another embodiment of a body.

In the exemplary embodiment depicted in FIG. 11, a body 10 may include a hole 76 (e.g., a through hole) extending, for example, along a diameter of the body 10.

Figure 12:
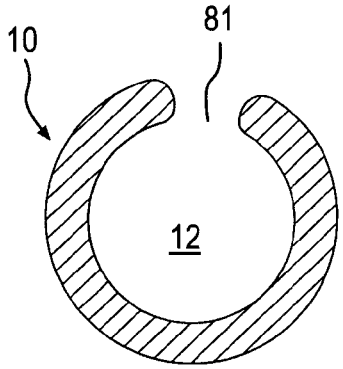
FIG. 12 is a schematic section view of a further embodiment of a body.

In the exemplary embodiment depicted in FIG. 12, a body 10 may define a hollow body having one or more inner cavities 12 communicating with the outside of the body 10 via one or more openings 81 (e.g., a single opening).

Figure 13:
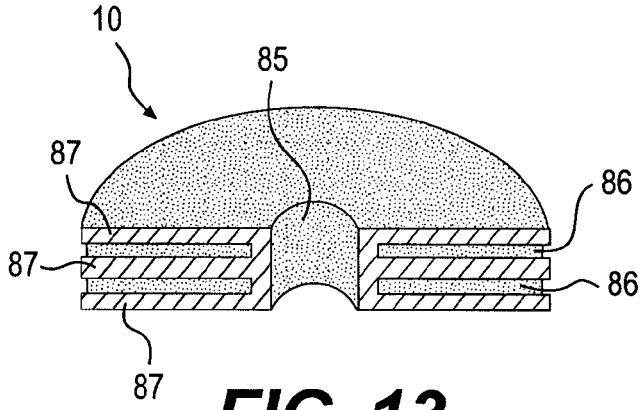
FIG. 13 is a schematic perspective section view of another embodiment of a body.
Figure 14:
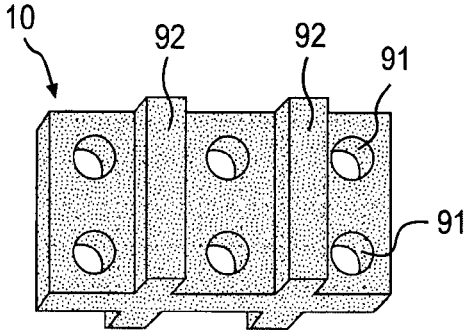
FIG. 14 is a schematic perspective view of a further embodiment of a body.
Figure 15:
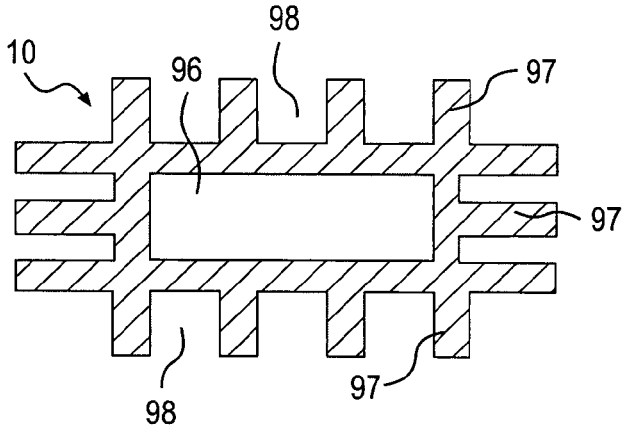
FIG. 15 is a schematic section view of another embodiment of a body.

In the exemplary embodiments depicted in FIGS. 13-15, a body 10 may have an overall shape that is other than substantially spherical. The exemplary embodiment of a body 10 depicted in FIG. 13, for example, may have a generally annular shape defining a hole 85 (e.g., substantially centrally located) and one or more fins 87 defining one or more annular grooves 86. The exemplary embodiments of a body 10 depicted in FIGS. 14 and 15 may have a generally polyhedral in shape. The exemplary embodiment depicted in FIG. 14, for example, may define a substantially parallelepipedic shape having cavities comprising one or more holes 91 and one or more ribs 92 that may define spaces between the ribs 92 (e.g., when there is more than one rib 92). The exemplary embodiment depicted in FIG. 15 may include a hole 96 (e.g., a through hole) having for example, a substantially rectangular cross-section, and one or more fins 97 that may define cavities 98 between the fins 97 (e.g., when there is more than one fin 97).

In some exemplary embodiments, a body 10 may be formed via molding material incorporating particles into a matrix material before forming the body 10. In such an embodiment, irrespective of the shape of the body 10, cavities may be arranged, for example, so as to allow relatively simple demolding of the body 10 during its manufacture, for example, to facilitate the use of a two-part mold. After molding, the body may undergo treatment to erode its surface such that particles at least partially come into direct contact with the product P. For example, a number of bodies 10 may be placed in a drum together along with an abrasive agent such as, for example, sand, and the drum may be rotated for a sufficient period of time to, for example, abrade the bodies 10. Other abrasive agents and other methods of abrading may also be used to form the bodies 10. The body 10 may be formed with one or more cavities by a method other than injection molding of plastic. For example, the body 10 may be formed via roto-molding and/or machining.

Optionally, the body 10 shown in the drawings may include a ceramic material, which may be formed, for example, before firing. Some examples of binders includes a cement, a liquid, an oil and/or water.

It is to be understood that at least certain of the exemplary embodiments described above may be used, for example, to supply an antiseptic property, purifying property, exfoliating property, and/or circulatory property, (this list not being exhaustive) of natural compounds and/or compounds having a natural origin, such as, for example, metal and/or metal oxide, by diffusion of ions and/or other substances that may be released via these compounds into a cosmetic product and/or a beauty care product. The quantity of the substance(s) diffusing into the product P may be either greater or smaller in relation, for example, to the solubility of the particles 11 in the product P. The particles 11 may release substances into the product P in, for example, trace quantities.

By virtue of some exemplary embodiments of the invention, it may be possible, for example, by appropriate selection of the nature of the particles 11, to impart given properties to the product P without including in the initial product formulation a particular substance imparting the desired properties to the product P.

The product P may be of various types and may possess a variety of properties. The product P may be, for example, a liquid, a lotion and/or a cream, a powder, and/or a gel. For example, the product P may be an aqueous and/or alcohol solution, an oil and/or an emulsion. The product P may also be derived from contact between a liquid and a body 10 capable of dissociating in contact with this liquid.

The invention is not limited to the exemplary embodiments described above and the claims encompass embodiments not illustrated, for example, embodiments combining all or some of the characteristics of the various embodiments depicted herein.

The device according to some exemplary embodiments of the invention may be used to dispense cosmetic products and/or beauty care products, such as make-up products, dermatological substances, and/or pharmaceutical compositions used for treating and/or changing the appearance and/or scent of keratinous fibers, such as the skin, fingernails and/or toenails, and hair. However, in its broadest aspects, the present invention could be used to package and/or dispense many other substances.

Furthermore, sizes of various structural parts and materials used to make the above-mentioned parts are illustrative and exemplary only, and one of ordinary skill in the art would recognize that these sizes and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A method for manufacturing a device, the method comprising:

providing at least one body defining an outer surface, the at least one body comprising a binder and plurality of particles in the binder;

abrading the at least one body so as to at least partially expose at least some of the plurality of particles at the outer surface of the at least one body; and associating the at least one body with at least one of a cosmetic product and a beauty care product and a receptacle for containing the at least one body and the at least one of a cosmetic product and a beauty care product, such that during use of the device, the at least one body contacts the at least one of a cosmetic product and a beauty care product.

2. The method of claim 1, wherein the at least one body comprises a polymer.

3. The method of claim 1, and wherein the at least one body is formed via molding at least one material such that the at least one body defines at least one cavity visible to the naked eye.

* * * * *

UNITED STATES PATENT AND TRADEMARK OFFICE

CERTIFICATE OF CORRECTION

PATENT NO. : 7,524,126 B2
APPLICATION NO. : 11/819106
DATED : April 28, 2009
INVENTOR(S) : Jean-Louis H. Gueret It is certified that error appears in the above-identified patent and that said Letters Patent is hereby corrected as shown below:

In claim 3, column 10, line 33, "claim 1, and wherein" should read --claim 1, wherein--.

Signed and Sealed this

Sixteenth Day of June, 2009

JOHN DOLL
*Acting Director of the United States Patent and Trademark Office*